US005877593A

United States Patent [19]

Langford et al.

[11] Patent Number: 5,877,593

[45] Date of Patent: Mar. 2, 1999

[54] DISTORTED FIELD RADIO FREQUENCY ION SOURCE

[75] Inventors: Marian Lesley Langford, Farnborough; John Francis James Todd, Canterbury, both of Great Britain

[73] Assignee: The Secretary of State for Defence in Her Britannic Majesty's Government of the United Kingdom of Great Britain and Northern Ireland, Hants, United Kingdom

[21] Appl. No.: 860,276

[22] PCT Filed: Dec. 14, 1995

[86] PCT No.: PCT/GB95/02918

§ 371 Date: Jun. 17, 1997

§ 102(e) Date: Jun. 17, 1997

[87] PCT Pub. No.: WO96/19822

PCT Pub. Date: Jun. 27, 1996

[30] Foreign Application Priority Data

Dec. 22, 1994 [GB] United Kingdom ..... 9425984

[51] Int. Cl.[6] ..... H01J 49/12

[52] U.S. Cl. ..... 315/111.31; 315/111.81; 250/426

[58] Field of Search ..... 315/111.31, 111.81; 250/426

[56] References Cited

U.S. PATENT DOCUMENTS

| | | | |
|---|---|---|---|
| 3,317,790 | 5/1967 | Whitby | 250/426 X |
| 3,501,675 | 3/1970 | Cleaver et al. | 315/111.31 |
| 3,686,683 | 8/1972 | Powers et al. | 250/426 X |
| 3,809,896 | 5/1974 | Schuy et al. | 250/426 |
| 4,682,026 | 7/1987 | Douglas | 315/111.81 X |

OTHER PUBLICATIONS

Instruments And Experimental Techniques, vol. 26, No. 5, 1983 New York US, pp. 1188–1190, M S Abdugabbarov et al. "Ion source attachment to the MI–1201 mass spectrometer for analysing secondary ions".

Analytical Chemistry, vol. 64, No. 13, 1 Jul. 1992 pp. 1426–1433, XP 000295869 Jianguo Zhao et al "Liquid Sample Injection Using An Atmospheric Pressure Direct Current Glow Discharge Ionization Source."

*Primary Examiner*—Robert Pascal
*Assistant Examiner*—Justin P. Bettendorf
*Attorney, Agent, or Firm*—Nixon & Vanderhye P.C.

[57] ABSTRACT

An rf ion source suitable for low power operation over a range of pressures in air comprises discharge electrodes having one or more cathodes (1) and an anode (2). Each cathode (1) is connected to an rf signal supply (8) through an associated coupling means (4) and the anode (2) is adapted to provide a surface area over which a plasma discharge may occur that is not substantially greater than the total cathodal area over which the discharge may occur. In this way, the anode (2) presents no more useful surface than is required to accommodate the optimum area of the plasma discharge thereby preventing plasma wander and enhancing the stability of the discharge over known ion sources. By configuring the electrodes such that the respective areas of the anode and the cathode(s) over which discharge occurs are separated by no more than 5 mm and by forming the electrodes to have highly curved ends and so creating a highly distorted electric field in the inter-electrode gap when the source is in operation, it is possible to create an effective discharge with very low power input even at atmospheric pressure.

20 Claims, 5 Drawing Sheets

Fig.3.
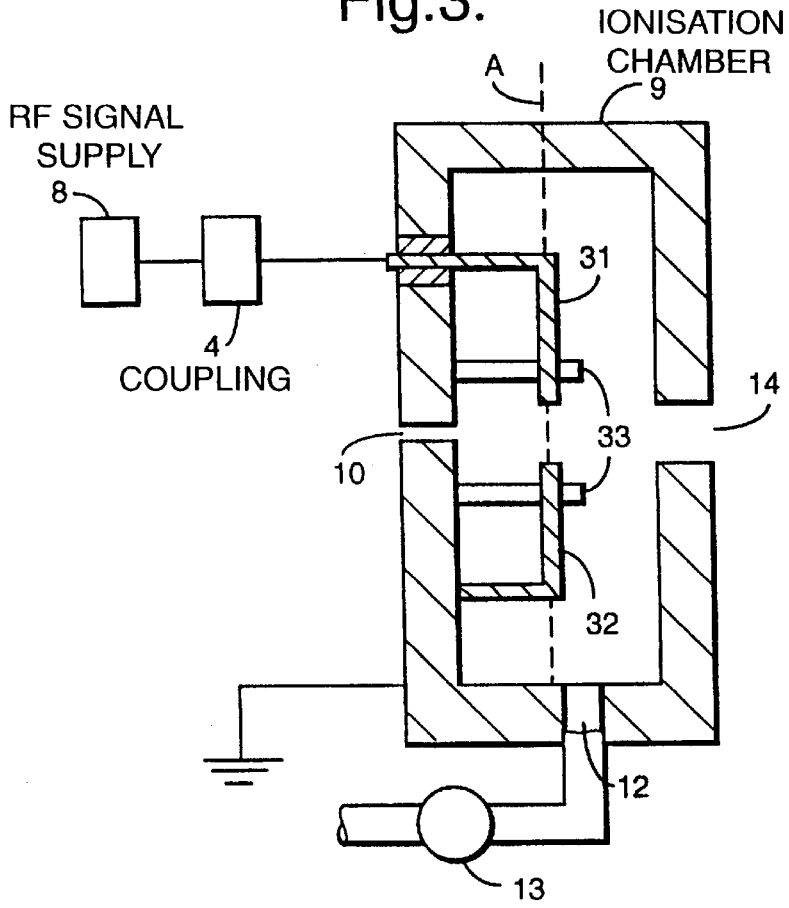
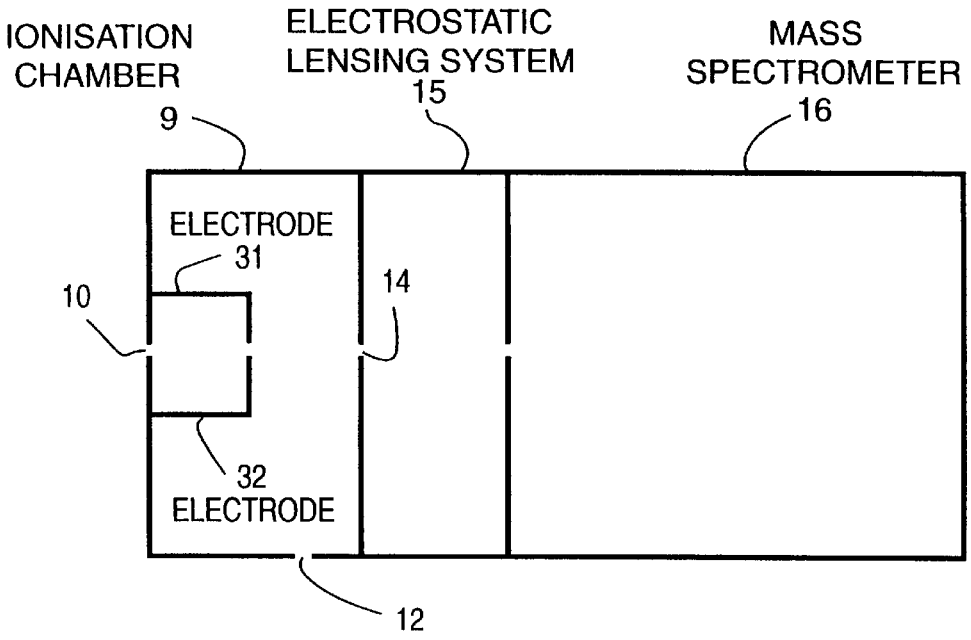
Fig.4.

DISTORTED FIELD RADIO FREQUENCY ION SOURCE

BACKGROUND OF THE INVENTION

1. Field of the Invention

The present invention relates to a radio frequency (rf) ion source and in particular to a glow discharge source capable of low power operation over a range of pressures, including atmospheric, in air.

2. Discussion of Prior Art

There exists considerable interest in the development of an ion source which is capable of operating under similar conditions to the commercially available electron impact ion source but which is more versatile and more robust than that source. The electron impact ion source is widely used in vapour analysis systems in which it is coupled to a mass spectrometer. In this source ionising particles in the form of electrons are emitted from a heated tungsten wire into a low pressure cavity, which is evacuated to pressures in the region of $10^{-4}$ to $10^{-3}$ Torr. The electrons in this cavity are accelerated by both electric and magnetic fields to an energy where impact of an electron with a sample molecule causes ionisation of that molecule. The electron impact ion source has the disadvantages that it cannot operate at high pressures and that it tends to bum out in oxygen rich environments, making the source unsuitable for use in analysis systems which operate in air at or close to atmospheric pressure.

Additionally, this source has the further disadvantage that it lacks versatility of use since it is effectively limited to the production of positively charged ions in a relatively energetic ionisation process (so called 'hard' ionisation) and usually has associated with it sample molecule fragmentation.

There also exists considerable interest in the development of an ion source capable of operating efficiently at atmospheric pressure with air as the discharge gas in which the plasma is maintained and of interfacing with commercially available mass spectrometers. This would allow for the direct sampling of air in order to monitor for the presence of impurity gases, given off for example from some drugs or explosives such as TNT, RDX and PETN.

One known device, which can operate in air at atmospheric pressure, is that described by Zhao and Lubman (Analytical Chemistry Vol 64, No 13, pages 1427–1428 and Vol 65, No 7, pages 866–876) and comprises an insulated tungsten rod driven electrode, of 0.04" diameter and ground at the end to a sharp tip which is the operative end at which a plasma discharge can occur. This electrode is coupled to an rf source and extends into a grounded 1"×0.8" (diameter) brass cell which forms an effective "plate" electrode. In use the plasma discharge occurs between the operative end of the rod and the cell walls. The sample, ions from which are to be produced and detected, is introduced into the sample-carrying discharge gas as a liquid and carried by the gas into the brass cell where it is ionised. This device however requires a power supply capable of providing the relatively high forward power of approximately 16 Watts (W) to induce the formation and maintenance of a plasma in air at atmospheric pressure. This has the disadvantage that the power supply is relatively costly and bulky.

Furthermore, even at this relatively high forward power this ion source produces only soft (low energy) ionisation and therefore cannot substitute for the electron impact ion source. If hard (high energy) ionisation is needed, then a higher power rf source would be required. This would compound the aforementioned disadvantage since to provide a hard ionising source a power supply which is capable of providing even higher forward powers than those discussed above will be necessary. Moreover, since the plasma generated by the Lubman ion source is stable only over a limited rf range of 125–375 Kilohertz (KHz), then a further disadvantage is that a relatively large ion energy distribution is likely to result which would effectively reduce the resolution of any analysis system incorporating a mass spectrometer. This is because the energy gained from the rf electric field by the ionised particles is, in part, dependent on the frequency of that rf field, as will be readily appreciated by those skilled in the art. If the ionised particles reside in the field long enough to suffer several oscillations of the rf field then their resultant energy will be close to zero, conversely if these particles are formed and ejected from the plasma within the time scale of the rf cycle then their energy will depend on the change in field potential between their formation and ejection. Thus, for a given residence time of an ion created in a radio frequency discharge, the energy distribution of the ejected ionised particles increases as the frequency of the rf field decreases.

Generally in rf ion sources both positive ions and electrons are generated within the plasma. The difference in the mobilities of these charged particles causes a self-bias to develop on the electrode which is capacitatively coupled to the rf power supply. The degree of this self-bias is governed by the geometry of the source and in particular by the relative surface areas of the discharge electrodes, between which a plasma may form. In prior art devices the geometry of the source is such that the surface area of operative end of the driven electrode is small compared with that of the operative end of the grounded (or floating) electrode, which electrode often includes the contacting walls of the ionisation cell. This results in the generation of a negative self-bias. For this reason the driven electrode is customarily termed the "cathode" and the grounded (or floating) electrode the "anode" and therefore throughout this document the terms cathode and anode shall be taken to refer to the driven and grounded (or floating) electrodes respectively.

SUMMARY OF THE INVENTION

It is an aim of the present invention to provide a positive and negative ion producing source which is able to produce a stable plasma over a wide range of rf operating frequencies, rf peak to peak amplitudes and source pressures.

According to the present invention there is provided an rf ion source comprising one or more cathodes, an anode, and coupling means operably connected to each associated cathode for coupling the associated cathode to an rf signal supply wherein the anode and cathode are separated by not more than 5 mm and wherein the area of the anode over which discharge can occur is not substantially greater than the corresponding total area of the cathode or cathodes over which discharge can occur and the cathode or cathodes are configured such that, in operation of the source, the electric field in the space between the anode and the cathode(s) is substantially distorted so as to encourage maximal formation of ions and electrons therein.

By adopting a configuration for the cathode(s) and in particular a high degree of surface curvature at the end(s) thereof, the corona effect (or flow of electrons between the electrodes) is enhanced leading to a larger electron current flowing between the electrodes than would be the case in an undistorted field. As will readily be appreciated by the skilled person such effects can, for example, be achieved by using very fine electrodes for the cathode(s), typically wire electrodes. Because the density of charge on the surface of a conductor is inversely proportional to the radius of curvature at the surface of the conductor, on a negatively charged needle electrode electrons will be concentrated at the tip of the electrode and, as a consequence a greater stream of electrons will be emitted from the needle tip than would be emitted from a more blunt electrode operating at the same given applied voltage. In other words the corona effect will be enhanced. This enables the applied rf power required to produce ionisation to be reduced with respect to other geometries of cathode.

By adopting a configuration for the cathode(s) which leads to a significantly distorted electric field around the exposed edges of the cathode(s) and in the inter-electrode gap, the production of ion/electron pairs is enhanced. This is because neutral particles with a dipole moment moving in such a highly distorted electric field rapidly gain potential energy which can be converted into kinetic and/or internal energy in either case leading to an increased probability of ionisation ("field ionisation"). A further effect which has been noted by the present inventors is that useful ionisation of the surrounding gas along the exposed length of each cathode occurs with a relatively slender cathode and this provides an additional source of electrons and ions which again serves to reduce the applied power required to initiate and maintain a plasma discharge.

Moreover, the concentration of charge at the tip of a needle electrode which has been primarily designed to increase the flow of electrons between the electrodes by increasing the corona effect, is itself a further cause of distortion in the electric field in the inter-electrode gap and as a result the production of ion/electron pairs is yet further enhanced.

The overall increase in available current greatly reduces the voltages (and consequently the powers) which are required both to initiate the plasma and to maintain it. The power demands are also further minimised by establishing the inter-electrode gap at a separation of not greater than 5 mm. However, it will be readily appreciated by those skilled in the art that if the discharge electrodes are too close then the size of plasma will be too small to produce a useful ionisation. Therefore it is advantageous if each of the one or more cathodes are arranged substantially equidistant from the anode to define a gap therebetween of typically not less than 0.5 mm.

It has also been discovered that if the surface area of the anode over which plasma discharge can occur is large compared with the plasma area then the plasma can wander over the surface and that this contributes to the instability of the plasma generated in prior art sources. This is believed to be in part due to the fact that as the plasma forms it changes the surface conditions of the anode in the vicinity of the plasma so that conditions on other parts of the surface become more favourable to plasma formation. By instead configuring the anode such that the said area of the anode over which plasma discharge can occur is not substantially greater than the corresponding total area of the cathode or cathodes over which discharge can occur, the ability of the plasma discharge to wander is reduced. Preferably the surface area of the anode over which plasma discharge can occur should be somewhat less than the corresponding total area of the cathode or cathodes over which discharge can occur and more specifically it is desirable that the surface area of the anode over which discharge can occur should be no greater than substantially the cross-sectional area of the discharge created when the source is operational.

It will be appreciated by those skilled in the art that the areas over which plasma discharge can occur are essentially limited to those areas respectively of the anode and cathode (s) which are in closest proximity. In a prior art ion source of the abovedescribed type however the area of the anode which is proximal to the cathode is very extensive because substantially the whole of the ionisation chamber walls act as the anode. The increased plasma stability which is the result of configuring the electrodes according to the present invention provides a greatly advantageous feature of the ion source according to the invention as compared to prior art sources.

Whilst it is above stated that the surface area of the anode over which discharge can occur should not be substantially greater than the corresponding total area of the cathode or cathodes over which discharge can occur and preferably not substantially greater than the cross-sectional area of the discharge itself, the minimum area which the anode may usefully have is dependent upon the thermal conductivity of the metal from which it is made ie the minimum area of the anode depends upon its ability to conduct heat away from the plasma discharge surface to prevent damage and distortion to the anode. Such area is typically not less than 0.5 times the total cathodal area over which discharge may occur.

In use the rf ion source is operated in the so called normal glow discharge regime, usually at an operating power just below that required for the onset of the so called abnormal glow discharge regime so as to ensure that the source produces the maximum area of plasma discharge under any given operating conditions. Since the power required to achieve this increases as the total surface area of the cathode (s) increases and in order to reduce the power required in operation of the source, it is advantageous to make the cathodal area (and consequently the anode) as small as possible whilst still being capable of providing a useful plasma discharge. For this reason and also bearing in mind the requirement for severe distortion of the electric field in the inter-electrode gap, it will be apparent that all of the discharge electrodes for the source of this invention may conveniently be formed using commercially available wire, thin rod or bar. Such materials also have the advantage of being inexpensive both as regards initial cost and as regards manufacture into suitable electrodes.

Although the ion source of this invention may be operated at a wide range of rf frequencies, particularly up to the MHz region, the use of high rf frequencies is particularly advantageous since, from the foregoing discussion on frequency effects, it is clear that as the rf frequency increases the energy distribution of the ionised particles decreases thereby increasing the resolution of an analysis system which incorporates a mass spectrometer operatively coupled to the source of the present invention.

Most usefully, the applied rf power required to produce ionisation may be further reduced by having the coupling means adapted to capacitively couple its associated cathode through an rf power amplifier to the rf source since in this arrangement the flow of any net current through the system is substantially reduced thereby allowing the voltage drop between the each of cathodes and the anode to increase.

The reductions in rf power required to form and maintain a plasma enables the source to be operated at rf powers typically in the region of as low as only 0.1 W for air as the sample carrying discharge gas when operated at 1 Torr and in the region of 1 W when operated at atmospheric pressure. This relatively low power requirement has an advantage that it is possible to power even a multi-cathode source, operating at atmospheric pressure, using miniaturised components on a circuit board which facilitates their large volume production. Furthermore, since the source is able to operate at such low powers then where hard ionisation is required, for example when the source is used to substitute for the electron impact source, the additional power requirements may still be met using miniaturised components. Most preferably each coupling means comprises a variable capacitance matching circuit in operable connection with an individual variable power rf amplifier. In this configuration the forward power at each cathode may be individually maximised and the magnitude of the rf voltage amplification individually adjusted for each plasma discharge gas.

Additionally, when a multiple cathode arrangement is used, preferential plasma formation may occur between the anode and the cathode where the characteristics were energetically most favourable, for example the closest cathode if the anode/cathode separation is not identical for each cathode. This results in the problem that plasma discharges at the other cathode or cathodes would only be achieved by a significant increase in the amplification of the rf power. This problem may be alleviated if each cathode has its own variable power rf amplifier and matching circuit.

Also usefully the separation between the anode and the one or more cathodes is variable so as to permit optimisation of the plasma discharge. Usefully, where more than one cathode is employed then the rf signal supply may comprise a plurality of rf signal generators, one for each cathode. This has the advantage that the phase of each rf signal to each cathode could be altered. In an especially preferred embodiment the ion source according to the present invention comprises a single cathode and anode arrangement. This has the advantages of ease of manufacture and operation compared with the multiple cathode source.

It has been found that with the ion source of the present invention a range of operating conditions in relation to the pressure and flow rate of the sample carrying discharge gases may be employed without unduly reducing the stability of the plasma discharge. By contrast a direct current glow discharge ion source can only operate in a stable fashion within a narrow range of pressures around 1 Torr.

In order to protect the discharge electrodes against physical damage and in order to facilitate the introduction of samples to be ionised, especially in gases other than air or where the pressure of the gas is required to be either above or below atmospheric pressure to optimise ionisation conditions, the ion source of the present invention may usefully further comprise an ionisation chamber adapted to provide for the through flow of sample carrying gas and in which the discharge electrodes are located. This chamber may be configured to have an inlet and an outlet to provide for the through flow of the sample carrying gas and an interface orifice through which samples of ionised particles can pass. In this configuration the discharge electrodes may be positioned within the ionisation chamber so as to be capable of providing a plasma discharge proximal to and across both the inlet and the outlet.

Charged particles which leave the rf plasma axially, ie in the direction of one of the discharge electrodes, gain variable amounts of energy in the accelerating potential field associated with the cathode or the anode. This gives rise to a broad energy distribution of these particles. Thus, in situations where it is important to minimise the energy distribution of the ionised particle samples, for example where the samples are to be analysed by a mass spectrometer, it is preferable to arrange the interface orifice and the discharge electrodes so that only ionised particles leaving the plasma at an angle, and preferably substantially perpendicular, to the axis of the plasma connecting the discharge electrodes pass through the orifice. Using this arrangement the ionised particles do not pass through the high field regions near the electrodes.

A means for accelerating the flow rate of the sample carrying gas, for example a pump or fan, may usefully be incorporated into one or both of the inlet or the outlet thereby effectively increasing the availability of the sample for ionisation. It will be appreciated by those skilled in the art that the actual flow rate will be dependent to some extent on the use to which the ion source will be put, for example where a narrow energy distribution is required then the time the ions are resident within the plasma should be longer and consequently the flow rate slower than when there is not this requirement, but flow rates of typically 6 $cm^3/s$ may be used when sampling substances in air.

BRIEF DESCRIPTION OF THE DRAWINGS

Embodiments of the rf ion source according to the present invention will now be described, by way of example only, with reference to the drawings in the accompanying figures of which:

FIG. 3 is a schematic representation of a single cathode configuration in place within an ionisation chamber.

FIG. 4 is a schematic representation of the embodiment of FIG. 3 interfaced with a commercially available ion trap mass spectrometer.

DETAILED DISCUSSION OF PREFERRED EMBODIMENTS

Figure 1:
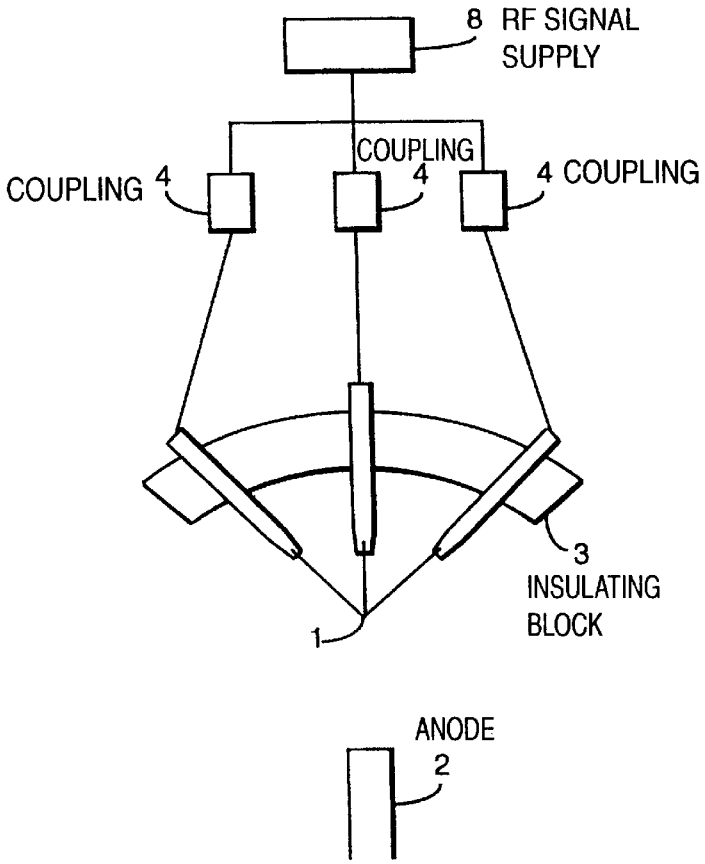
FIG. 1 is a schematic representation of a 3-cathode configuration of the ion source according to the present invention.
Figure 2:
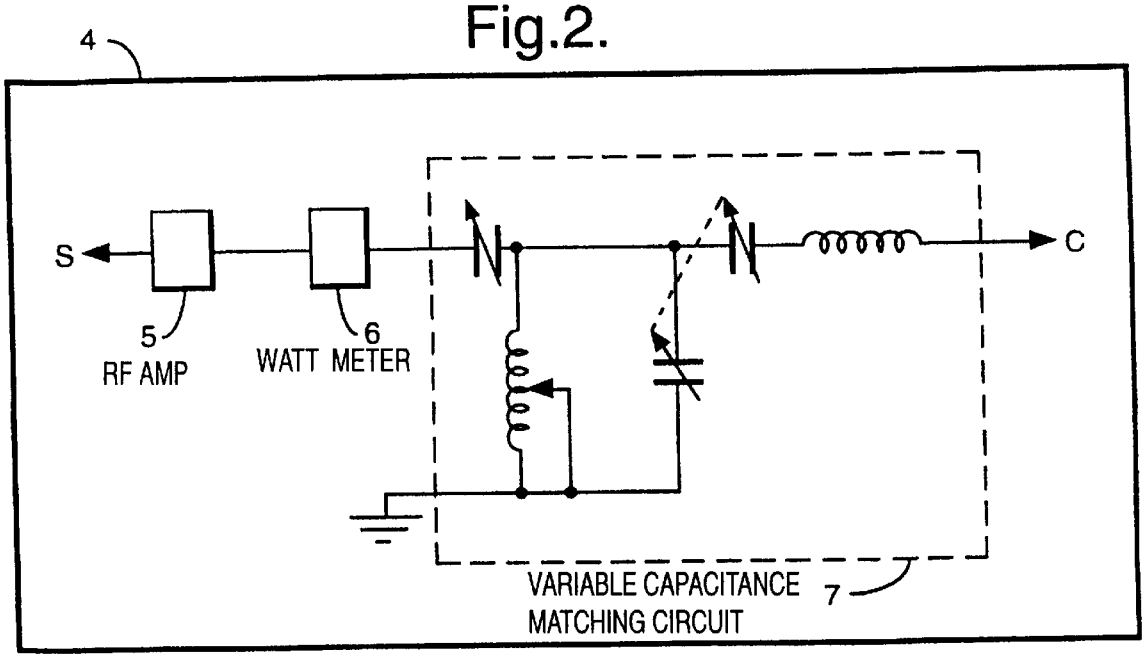
FIG. 2 is a schematic representation of a coupling means suitable for use in an ion source according to the present invention.

The rf ion source shown in FIGS. 1 and 2 comprises three cathodes (1) arranged to be equi-distant at a spacing of 2 mm from the single anode (2). These discharge electrodes (1,2) are fabricated from 0.9 mm diameter Fecralloy wire (commercially available from Goodfellow Cambridge Limited, Cambridge Science Park, Cambridge UK, [product code: FE085240]), but it will be appreciated that any suitably dimensioned electrical conductor may be substituted, with the tip of the cathode (1) being drawn into a needle point.

The cathodes (1) are electrically insulated from each other by mounting them in an insulating block (3) which is positioned on the cathodes (1) so as not to be susceptible to damage from the heat of the plasma discharge. A separate coupling means (4) is provided for each cathode (1) comprising a linear response rf amplifier (5) which is coupled to its respective cathode (1) through a wattmeter (6) and associated variable capacitance matching circuit (7). The variable capacitance matching circuit (7) is configured so that the cathode (1) can be connected to the electric circuit at (C) and rf signal supply (8) can be connected to the electric circuit before the amplifier (5) at point (S). Thus the coupling means is essentially similar to ones used in prior art ion source except that the rf amplifier is adapted to operate in the sub-W amplification region. Each low powered linear response rf amplifier (5) is operably connected to an rf signal supply (8). It will be appreciated by those skilled in the art that the rf signal supply (8) may comprise a common rf signal generator or may comprise three such generators, one connected to each cathode, depending on the application to which the source is to be put.

Referring now to FIG. 3, the ion source comprises a single, flat ended cathode (31) and an anode (32) which again are formed from 0.9 mm diameter Fecralloy wire or some other suitably dimensioned electrical conductor. These discharge electrodes (31,32) are positioned so that a plasma discharge will occur across and approximately 0.5 cm from a 200 $\mu$m diameter inlet (10) for a sample carrying gas through a wall of the ionisation chamber (9). The cathode (31) and the anode (32) are each maintained in this position by an insulating ceramic bridge support (33) with the cathode (31) passing through and insulated from the ionisation chamber (9) to connect with an rf signal supply (8). This comprises a single rf signal generator and is connected to the cathode via a coupling means (4) whereas the anode (32) is connected to earth through the walls of the ionisation chamber (9). The ionisation chamber (9) is further provided with an outlet (12) through which the gas is drawn out by a pump (13). An interface orifice (14) is also provided in a wall of the ionisation chamber (9), opposite the inlet (10) and positioned so as to be capable of collecting only samples of ions emitted substantially perpendicular to the axis (A) of the plasma which connects the discharge electrodes (31,32).

An example of the application for which the ion source of FIG. 3 is particularly suitable is shown schematically in FIG. 4. Here the ionisation chamber (9) is arranged so that the interface orifice (14) is operably connected to an electrostatic lensing system (15) and then to a conventional mass spectrometer (16), such as the ion trap mass spectrometer commercially available from Finnigan MAT Limited, Paradise, Hemel Hempstead, Herts, UK. This arrangement is particularly suited to the continuous sampling and analysing of the atmosphere to identify trace amounts of impurities contained therein because the ion source according to the present invention is capable of low power operation in air over a range of pressures, including atmospheric pressure.

Figure 5A:
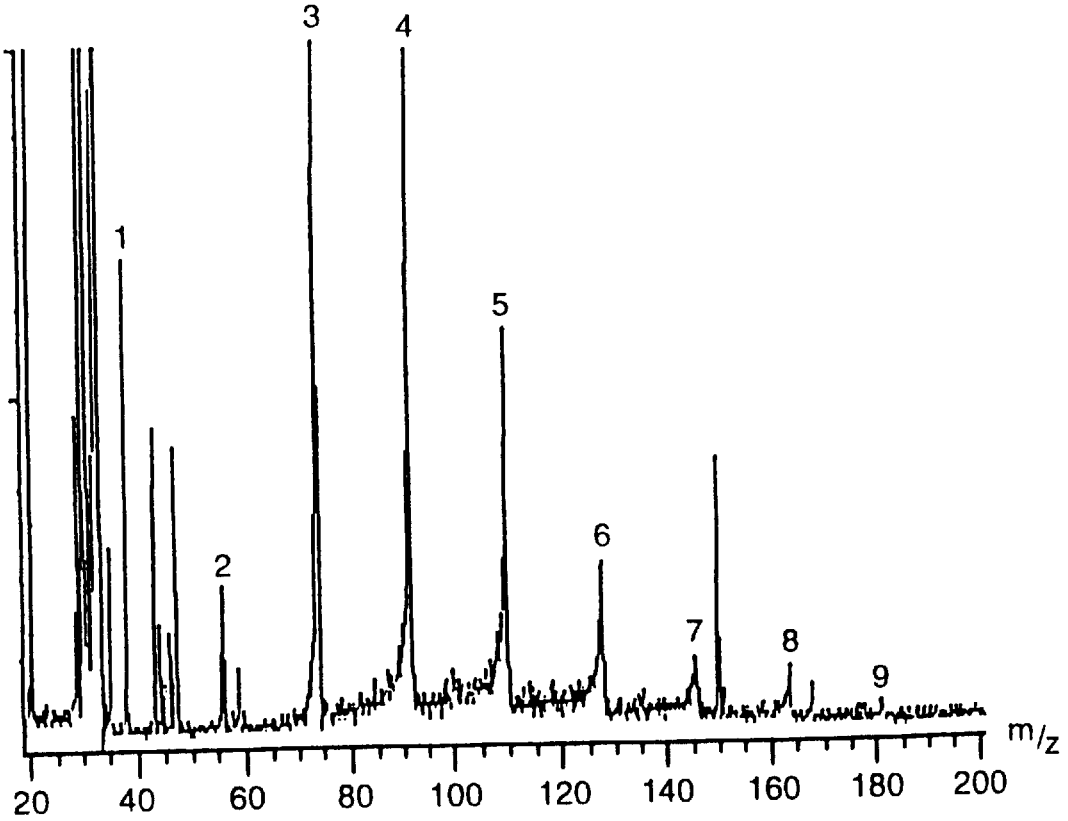
FIGS. 5(*a*) and 5(*b*) show representative spectra obtained for water clusters using the configuration shown in FIG. 4 operating in air at 960 mTorr where 5(*a*) is collected at 2.1 MHz and 5(*b*) is collected at 1.6 MHz.
Figure 5B:
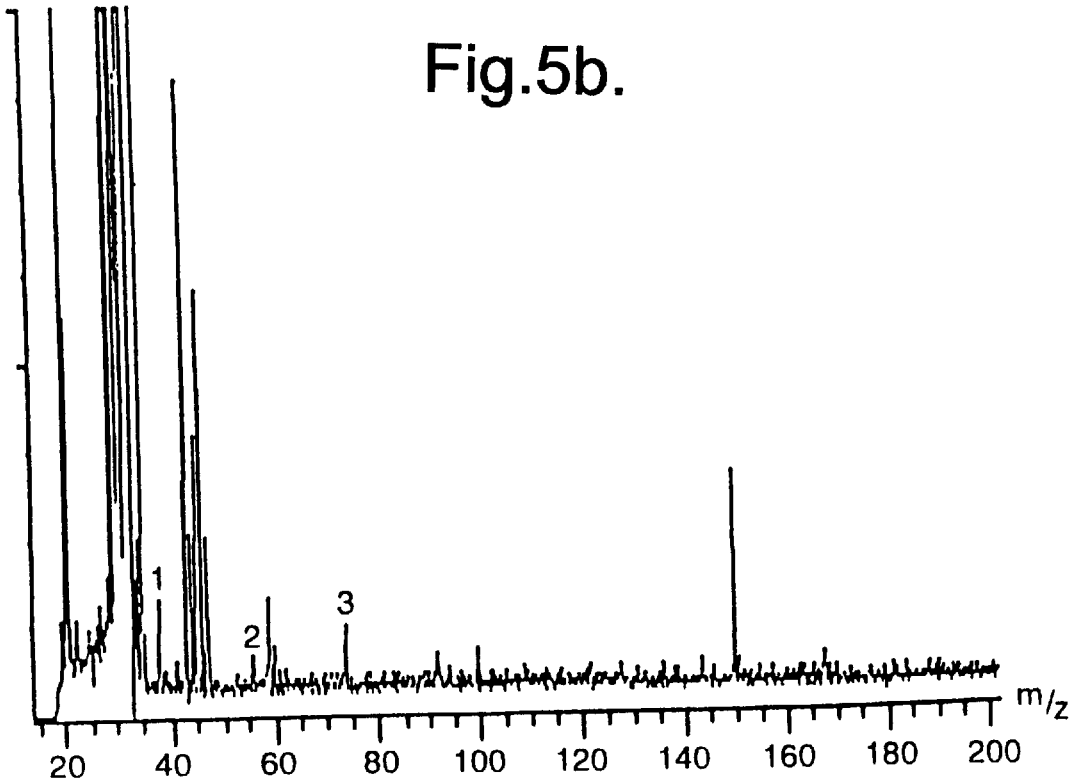
Figure 6A:
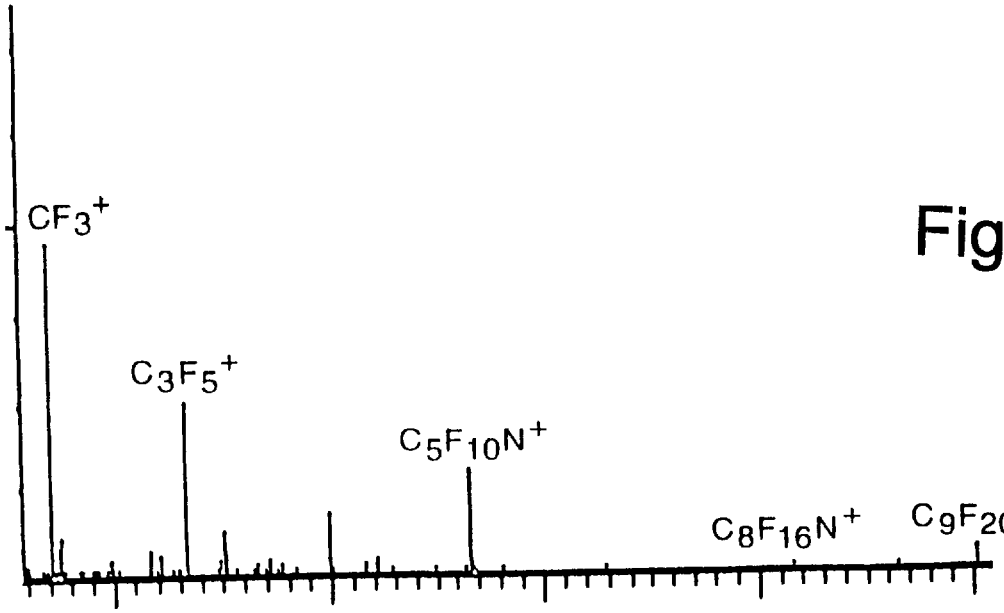
FIGS. 6(*a*) and 6(*b*) show representative spectra obtained for FC-43 using the configuration shown in FIG. 4 operating in air at 960 mTorr with an rf frequency of 2 MHz where 6(*a*) is using 0.1 W of applied power and 6(*b*) is using 0.4 W of applied rf power.
Figure 6B:
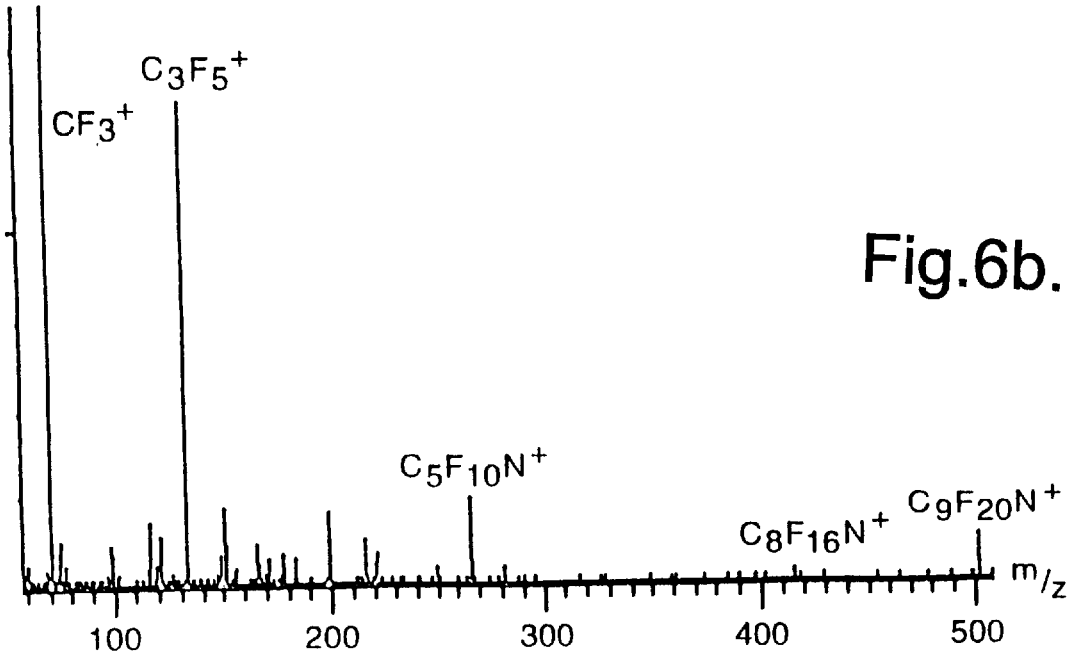
Figure 7A:
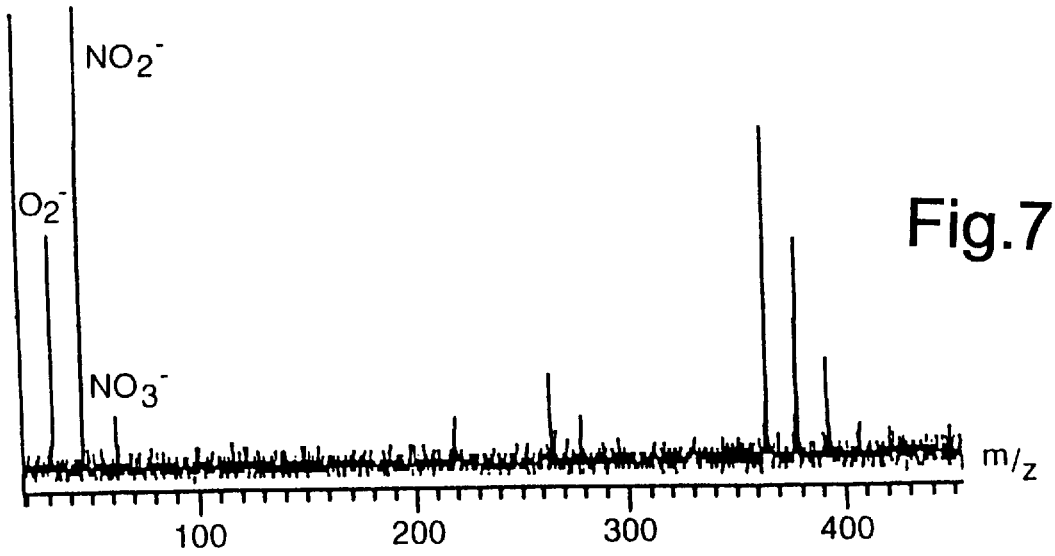
FIGS. 7(*a*), 7(*b*), and 7(*c*) show representative negative-ion mass spectra produced by generating a radio frequency discharge in air at 800 mTorr with an rf frequency of about 2 MHz and selecting negative ions from the discharge. 7(*a*) shows the spectrum up to m/z 450, 7(*b*) details lower mass ions and 7(*c*) details some higher mass ions.
Figure 7B:
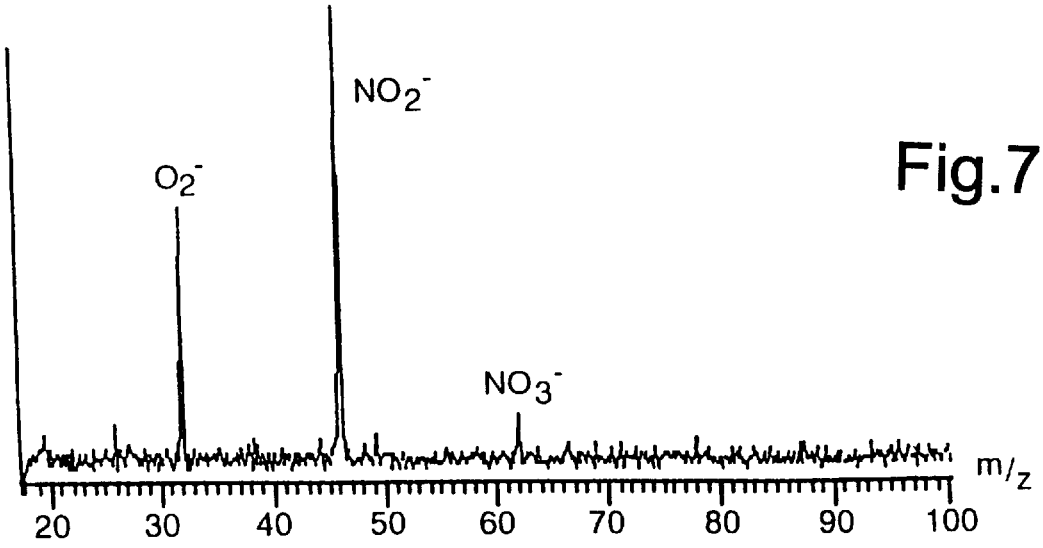
Figure 7C:
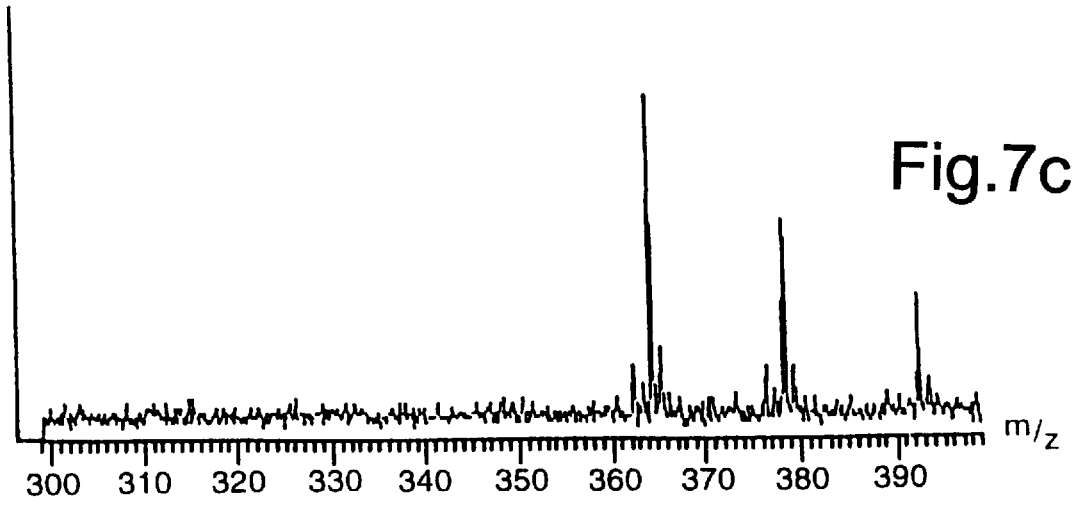

Examples of mass spectra plots of ion intensity against atomic mass to atomic charge ratio (m/z) which were obtained using an arrangement similar to that shown in FIG. 4 are provided in FIGS. 5 to 7. These spectra were generated using a plasma discharge generated in air below atmospheric pressure with applied rf powers of the order of 0.1 to 0.5 W and contain peaks characteristic both of the air and of the impurity (FIGS. 5 and 6). The impurity deliberately introduced into the air is either water clusters or small quantities of FC-43 (perfluorotri-n-butylamine, $C_{12}F_{27}N$) vapour and is introduced by allowing the air stream to pass over a glass spoon containing typically 0.1 ml of water or FC-43 liquid before it passed through the inlet (10). No impurity was introduced in the case of the spectra provided in FIG. 7.

FIGS. 5 (*a*) and (*b*) show mass spectra for water cluster impurities collected using a) 2.1 MHz rf field and b) 1.6 MHz rf field, both at a power of 0.1 W and at a pressure of 960 mTorr. Water clusters, $H_3O^+(H_2O)_n$, require little energy to dissociate them and therefore are a useful indicator of the ability of the plasma discharge to cause fragmentation or ionisation. The peaks associated with different values of n are indicated on FIGS. 5 (*a*) and (*b*). In the spectrum generated at 2.1 MHz clusters were recorded with n=1–9 whereas when the rf frequency was reduced to 1.6 MHz clusters with n>3 were lost. The greater fragmentation at the lower frequency indicates that the ionising particles from the ion source become harder as the rf frequency is decreased.

FIGS. 6 (*a*) and (*b*) show representative mass spectra of ions produced from FC-43 and the variations in their intensity with applied rf power. FIGS. 6 (*a*) and (*b*) show mass spectra obtained using (a) 0.1 W and (b) 0.4 W and indicate the presence of positive ions identified as $CF_3$ (m/z=69), $C_3F_5$ (m/z=131) and $C_5F_{10}N$ (m/z=264). These spectra illustrate that effective ionisation occurs even at these low powers and that, analogous with the high powered prior art ion source, ionisation becomes harder as the power increases.

FIGS. 7 (*a*), (*b*), and (*c*) demonstrate the operation of the rf ion source in negative-ion collection mode. These spectra were collected at a source pressure of 800 mTorr and were generated by an rf discharge created in air, without the deliberate introduction of any impurity into the air stream.

We claim:

1. A low power rf ion source comprising:

at least one cathode, an anode, an rf signal supply, and coupling means operably connected to said at least one cathode for coupling the at least one cathode to said rf signal supply wherein the anode and the at least one cathode are separated by not more than 5 mm and wherein the area of the anode over which discharge occurs is not substantially greater than the corresponding total area of the at least one cathode over which discharge occurs and the at least one cathode is configured such that, in operation of the source, the electric field in the space between the anode and the at least one cathode is substantially distorted so as to encourage maximal formation of ions and electrons therein.

2. An rf ion source as claimed in claim 1 wherein the surface area of the anode over which the discharge can occur is less than the corresponding total area of the at least one cathode over which discharge can occur.

3. An rf ion source as claimed in claim 2 wherein the surface area of the anode over which discharge can occur is no greater than substantially the cross-sectional area of the discharge created when the source is operational.

4. An rf ion source as claimed in claim 1 wherein the anode and said at least one cathode are fabricated from wire.

5. An rf ion source as claimed in claim 1 wherein each of the at least one cathode is formed into a needle point.

6. An rf ion source as claimed in claim 1 wherein each of at least one cathode is arranged substantially equi-distant from the anode to define a gap between the anode and said at least one cathode of from 0.5 mm to 5 mm.

7. An rf ion source as claimed in claim 6 wherein the at least one cathode and the anode are moveable relative to one another to define a variable gap therebetween.

8. An rf ion source as claimed in claim 1 wherein the coupling means is adapted to capacitively couple said at least one cathode to an rf signal supply.

9. An rf ion source as claimed in claim 8 wherein the coupling means comprises a variable capacitance matching circuit in operable connection with an rf power amplifier.

10. An rf ion source as claimed in claim 9 wherein the rf power amplifier is a low power linear response amplifier.

11. An rf ion source as claimed in claim 1 wherein said at least one cathode is one cathode.

12. An rf ion source as claimed in claim 1 further comprising an ionisation chamber in which discharge electrodes comprising said anode and said at least one cathode are housed, said chamber having an inlet and an outlet configured to provide for the through flow of sample carrying gas and an interface orifice adapted to permit the passage of ionised particles out of the ionisation chamber.

13. An rf ion source as claimed in claim 12 wherein the discharge electrodes are cooperatively configured with the interface orifice so that only those ions emitted at an angle to an axis through a plasma and the discharge electrodes are capable of passing through the interface orifice.

14. An rf ion source as claimed in claim 13 wherein the cooperative configuration is such that only those ions emitted substantially perpendicular to the axis are capable of passing through the interface orifice.

15. An rf ion source as claimed in claim 12 wherein the discharge electrodes are positioned within the ionisation chamber so as to be capable of providing a plasma discharge proximal to and across the inlet.

16. An rf ion source as claimed in claim 1, wherein said cathode has a diameter of 0.9 mm.

17. An rf ion source as claimed in claim 1, wherein said low power rf ion source has a power range of between 0.1 and 0.5 watts.

18. A low power rf ion source comprising:

at least one cathode;

an anode;

an rf signal supply; and coupling means operably connected to said at least one cathode for coupling the at least one cathode to said rf signal supply wherein the anode and said at least one cathode are separated by not more than 5 mm and wherein the area of the anode over which discharge occurs is not substantially greater than the corresponding total area of said at least one cathode over which discharge occurs and said at least one cathode is configured such that, during operation of the source, the electric field in the space between the anode and said at least one cathode is substantially distorted so as to encourage field ionisation of ions and electrons therein.

19. A low power rf ion source comprising:

at least one cathode;

an anode;

an rf signal supply; and coupling means operably connected to said at least one cathode for coupling the at least one cathode to said rf signal supply wherein the anode and said at least one cathode are separated by not more than 5 mm and wherein the area of the anode over which discharge occurs is not substantially greater than the corresponding total area of said at least one cathode over which discharge occurs and said at least one cathode is configured such that, in operation of the source, the electric field in the space between the anode and said at least one cathode is substantially distorted so as to encourage maximal formation of ions and electrons therein, said distortion at least partially caused by an increased charge concentration at an end of said at least one cathode.

20. A low power rf ion source comprising:

at least one cathode;

an anode;

an rf signal supply; and coupling means, operably connected to said at least one cathode, for coupling said at least one cathode to said rf signal supply wherein the anode and said at least one cathode are separated by not more than 5 mm and wherein the area of the anode over which discharge occurs is not substantially greater than the corresponding total area of said at least one cathode over which discharge occurs and said at least one cathode is configured such that, during operation of the source, wherein said at least one cathode has an end, said end having a high degree of curvature thereby substantially distorting the electric field in the space between the anode and said at least one cathode so as to encourage maximal formation of ions and electrons therein.

* * * * *